US007368022B2

(12) United States Patent
Yim et al.

(10) Patent No.: US 7,368,022 B2
(45) Date of Patent: May 6, 2008

(54) BULK AMORPHOUS REFRACTORY GLASSES BASED ON THE NI-NB-SN TERNARY ALLOY SYSTEM

(75) Inventors: Haein Choi Yim, Arcadia, CA (US); Donghua Xu, Berkeley, CA (US); William L. Johnson, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 304 days.

(21) Appl. No.: 10/520,320

(22) PCT Filed: Jul. 22, 2003

(86) PCT No.: PCT/US03/22933

§ 371 (c)(1),
(2), (4) Date: Oct. 13, 2005

(87) PCT Pub. No.: WO2004/009268

PCT Pub. Date: Jan. 29, 2004

(65) Prior Publication Data

US 2006/0237105 A1 Oct. 26, 2006

Related U.S. Application Data

(60) Provisional application No. 60/397,950, filed on Jul. 22, 2002.

(51) Int. Cl.
*C22C 45/04* (2006.01)

(52) U.S. Cl. ..... 148/403; 148/426; 420/441

(58) Field of Classification Search ..... 148/403, 148/426; 420/441

See application file for complete search history.

(56) References Cited

U.S. PATENT DOCUMENTS

| | | | |
|---|---|---|---|
| 2,106,145 | A | 1/1938 | Floraday |
| 2,124,538 | A | 7/1938 | Boyer |
| 3,322,546 | A | 5/1967 | Tanzman et al. |
| 3,539,192 | A | 11/1970 | Prasse |
| 3,776,297 | A | 12/1973 | Williford et al. |
| 3,948,613 | A | 4/1976 | Weill |
| 3,970,445 | A | 7/1976 | Gale et al. |
| 3,986,867 | A | 10/1976 | Masumoto et al. |

(Continued)

FOREIGN PATENT DOCUMENTS

DE 010237992 A1 3/2003

(Continued)

OTHER PUBLICATIONS

Author unknown, "Standard Practice for Conducting Dry Sand/Rubber Wheel Abrasion Tests", Designation G 65-81, source unknown, pp. 351-368.

(Continued)

*Primary Examiner*—George P. Wyszomierski
(74) *Attorney, Agent, or Firm*—Christie, Parker & Hale, LLP

(57) ABSTRACT

Bulk amorphous alloys based on a ternary Ni—Nb—Sn alloy system, and the extension of this ternary system to higher order alloys by the addition of one or more alloying elements, methods of casting such alloys and articles made of such alloys are provided.

28 Claims, 2 Drawing Sheets

U.S. PATENT DOCUMENTS

| | | | |
|---|---|---|---|
| 3,986,892 | A | 10/1976 | Ewe et al. |
| 4,024,902 | A | 5/1977 | Baum |
| 4,067,732 | A | 1/1978 | Ray |
| 4,124,472 | A | 11/1978 | Riegert |
| 4,125,737 | A | 11/1978 | Andersson |
| 4,163,071 | A | 7/1979 | Weatherly et al. |
| 4,260,416 | A | 4/1981 | Kavesh et al. |
| 4,268,564 | A | 5/1981 | Narasimhan |
| 4,330,027 | A | 5/1982 | Narasimhan |
| 4,374,900 | A | 2/1983 | Hara et al. |
| 4,381,943 | A | 5/1983 | Dickson et al. |
| 4,396,820 | A | 8/1983 | Puschner |
| 4,409,296 | A | 10/1983 | Ward |
| 4,482,612 | A | 11/1984 | Kuroki et al. |
| 4,487,630 | A | 12/1984 | Crook et al. |
| 4,488,882 | A | 12/1984 | Dausinger et al. |
| 4,499,158 | A | 2/1985 | Onuma et al. |
| 4,515,870 | A | 5/1985 | Bose et al. |
| 4,523,625 | A | 6/1985 | Ast |
| 4,526,618 | A | 7/1985 | Keshavan et al. |
| 4,557,981 | A | 12/1985 | Bergmann |
| 4,564,396 | A | 1/1986 | Johnson et al. |
| 4,585,617 | A | 4/1986 | Tenhover et al. |
| 4,612,059 | A | 9/1986 | Mori et al. |
| 4,656,099 | A | 4/1987 | Sievers |
| 4,668,310 | A | 5/1987 | Kudo et al. |
| 4,725,512 | A | 2/1988 | Scruggs |
| 4,731,253 | A | 3/1988 | DuBois |
| 4,741,974 | A | 5/1988 | Longo et al. |
| 4,770,701 | A | 9/1988 | Henderson et al. |
| 4,810,850 | A | 3/1989 | Tenkula et al. |
| 4,960,643 | A | 10/1990 | Lemelson |
| 5,127,969 | A | 7/1992 | Sekhar |
| 5,189,252 | A | 2/1993 | Huffman et al. |
| 5,288,344 | A | 2/1994 | Peker et al. |
| 5,294,462 | A | 3/1994 | Kaiser et al. |
| 5,368,659 | A | 11/1994 | Peker et al. |
| 5,380,349 | A | 1/1995 | Taniguchi et al. |
| 5,440,995 | A | 8/1995 | Levitt |
| 5,482,577 | A | 1/1996 | Hashimoto et al. |
| 5,567,251 | A | 10/1996 | Peker et al. |
| 5,567,532 | A | 10/1996 | Peker et al. |
| 5,735,975 | A | 4/1998 | Lin et al. |
| 6,010,580 | A | 1/2000 | Dandliker et al. |
| 6,183,889 | B1 | 2/2001 | Koshiba et al. |
| 6,218,029 | B1 | 4/2001 | Rickerby |
| 6,325,868 | B1 | 12/2001 | Kim et al. |
| 6,326,295 | B1 | 12/2001 | Figura |
| 2002/0036034 | A1 | 3/2002 | Xing et al. |

FOREIGN PATENT DOCUMENTS

| | | | |
|---|---|---|---|
| GB | 2005302 | A | 4/1979 |
| JP | 56-112449 | | 9/1981 |
| JP | 02001303218 | A | 10/2001 |
| WO | WO00/68469 | A2 | 11/2000 |
| WO | WO03/040422 | | 5/2003 |

OTHER PUBLICATIONS

Koch et al., "Prerparation of "Amorphous" $Ni_{60}Nb_{40}$ By Mechanical Alloying", Appl. Phys. Lett., Dec. 1983, vol. 43, No. 11, pp. 1017-1019.

Author unknown, "A World of Superabrasives Experience At Your Service", source unknown, 4 pgs.

Author unknown, "GE Superabrasives—The Metal Bond System", source unknown, 4 pgs.

Author unknown, "GE Superabrasives—The Resin Bond System", source unknown, 1 pg.

Author unknown, "GE Superabrasives—Micron Powders", source unknown, 1 pg.

Author unknown, "GE Superabrasives—The MBS 700 Series Product Line", source unknown, 2 pgs.

Author unknown, "GE Superabrasives—The MBS-900 Series Product Line", source unknown, 2 pgs.

Masumoto, "Recent Progress in Amorphous Metallic Materials in Japan", Materials Science and Engineering, 1994, vol. A179/A180, pp. 8-16.

ASM Committee on Tooling Materials, "Superhard Tool Materials", Metals Handbook, Ninth Edition, vol. 3, Properties and Selection: Stainless Steels, Tool Materials and Special Purpose Metals, American Society for Metals, 1980, pp. 448-465, title page and copyright page.

BULK AMORPHOUS REFRACTORY GLASSES BASED ON THE NI-NB-SN TERNARY ALLOY SYSTEM

CROSS-REFERENCE TO RELATED APPLICATIONS

This application is a National Stage of International Application No. PCT/US2003/022933, which claims the benefit of U.S. Provisional Application No. 60/397,950, filed Jul. 22, 2002.

STATEMENT REGARDING FEDERALLY SPONSORED RESEARCH

The U.S. Government has certain rights in this invention pursuant to Grant No. DAAD19-01-1-0525 awarded by the Army Research Office.

FIELD OF THE INVENTION

The present invention is directed to novel bulk solidifying amorphous alloy compositions, and more specifically to bulk solidifying amorphous alloy compositions based on the Ni—Nb—Sn ternary system.

BACKGROUND OF THE INVENTION

Amorphous alloys (or glassy alloys) have been typically prepared by rapid quenching from above the melt temperatures to ambient temperatures. Generally, cooling rates of $10^{5\circ}$ C./sec have been employed to achieve an amorphous structure in these materials. However, at such high cooling rates, the heat cannot be extracted from thick sections, and, as such, the thickness of articles made from amorphous alloys has been limited to tens of micrometers in at least in one dimension. This limiting dimension is generally referred to as the critical casting thickness and can be related by heat-flow calculations to the cooling rate (or critical cooling rate) required to form the amorphous phase.

This critical thickness (or critical cooling rate) can also be used as a measure of the processability of an amorphous alloy (or glass forming ability of an alloy). Until the early nineties, the processability of amorphous alloys was quite limited and amorphous alloys were readily available only in powder form or in very thin foils or strips with critical dimensions of less than 100 micrometers. However, in the early nineties, a new class of amorphous alloys was developed that was based mostly on Zr and Ti alloy systems. It was observed that these families of alloys have much lower critical cooling rates of less than $10^{3\circ}$ C./sec, and in some cases as low as $10^{\circ}$ C./sec. Using these new alloys it was possible to form articles of amorphous alloys having critical casting thicknesses of from about 1.0 mm to as large as about 20 mm. As such, these alloys are readily cast and shaped into three-dimensional objects using conventional methods such as metal mold casting, die casting, and injection casting, and are generally referred to as bulk-solidifying amorphous alloys (bulk amorphous alloys or bulk glass forming alloys). Examples of such bulk amorphous alloys have been found in the Zr—Ti—Ni—Cu—Be, Zr—Ti—Ni—Cu—Al, Mg—Y—Ni—Cu, La—Ni—Cu—Al, and other Fe-based and Ni-based alloy families. These amorphous alloys exhibit high strength, a high elastic strain limit, high fracture toughness, and other useful mechanical properties, which are attractive for many engineering applications.

Although a number of different bulk-solidifying amorphous alloy formulations have been disclosed in the past, none of these formulations contain a large amount of refractory metals, and as such they have limited high temperature stability. There is growing interest in developing bulk-solidifying amorphous alloys which have greater thermal stability and as well as higher strength and elastic modulus. Specifically, amorphous alloys which have a relatively high glass transition temperature, Tg, are of interest. These so-called "refractory" amorphous alloys could be used in a variety of high temperature applications presently unacceptable for traditional bulk amorphous alloys.

Accordingly, a need exists to develop bulk solidifying amorphous alloys with high temperature stability based on refractory metals.

SUMMARY OF THE INVENTION

The present invention is directed to bulk-solidifying amorphous alloys based on a Ni—Nb—Sn ternary system.

In one exemplary embodiment, the Ni—Nb—Sn ternary system is extended to higher alloys by adding one or more alloying elements.

In still another embodiment, the invention is directed to methods of casting these alloys into three-dimensional bulk objects, while retaining a substantially amorphous atomic structure. In such an embodiment, the term three dimensional refers to an object having dimensions of least 0.5 mm in each dimension, and preferably 1.0 mm in each dimension. The term "substantially" as used herein in reference to the amorphous metal alloy means that the metal alloys are at least fifty percent amorphous by volume. Preferably the metal alloy is at least ninety-five percent amorphous and most preferably about one hundred percent amorphous by volume.

BRIEF DESCRIPTION OF THE DRAWINGS

These and other features and advantages of the present invention will be better understood by reference to the following detailed description when considered in conjunction with the accompanying drawings wherein.

DESCRIPTION OF THE INVENTION

Figure 1A:
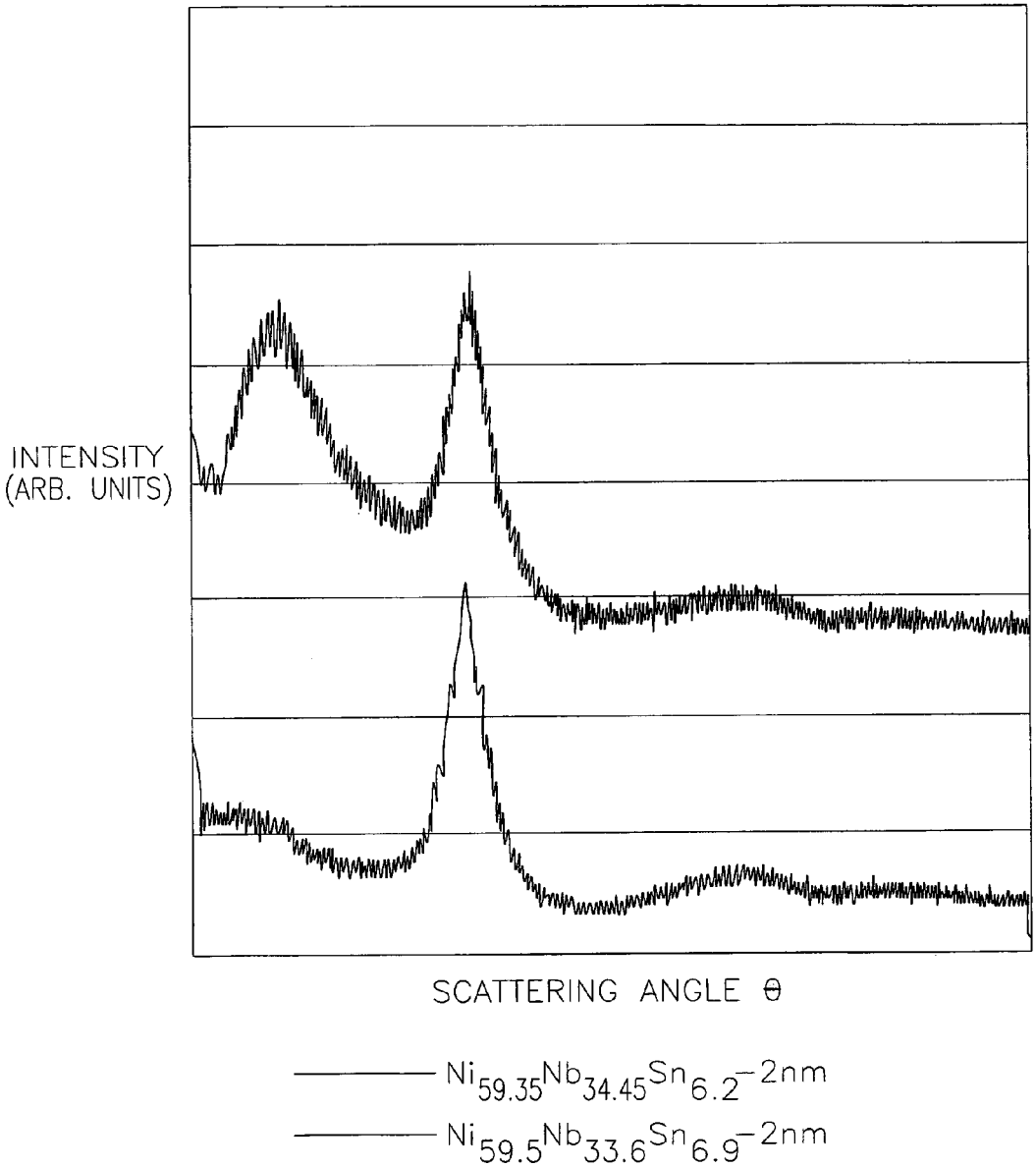
FIG. 1*a* is a graphical depiction of x-ray scans of an exemplary bulk amorphous alloy.

The present invention is directed to bulk-solidifying amorphous alloys based on a Ni—Nb—Sn ternary system, these alloys are referred to as Ni—Nb-based alloys herein.

The alloys of the current invention are based on ternary Ni—Nb—Sn alloy system, and the extension of this ternary system to higher order alloys by the addition of one or more alloying elements. Although additional components may be added to the Ni—Nb-based alloys of this invention, the basic components of the Ni—Nb base alloy system are Ni, Nb, and Sn.

Although a number of different Ni—Nb—Sn combinations may be utilized in the Ni—Nb-based alloys of the current invention, a range of Ni content from about 50 to 65 atomic percentage, a range of Nb content from about 30 to 45 atomic percentage, and a range of Sn content from about 2 to about 10 atomic percent are preferably utilized. To increase the ease of casting such alloys into larger bulk objects, and for increased processability, a formulation having a concentration of Ni in the range of from about 55 to about 62 atomic percentage; Nb in the range of from about 33 to about 40 atomic percentage; and Sn in the range of from about 2 to about 8 atomic percentage is preferred. Still more preferable is a Ni—Nb-based alloy having a Ni content from about 55 to about 59 atomic percent, a Nb content from about 33 to about 37 atomic percentage, and a Sn content in the range of from about 2 to about 5 atomic percentage.

Although only combinations of Ni, Nb, and Sn have been discussed thus far, it should be understood that other elements can be added to improve the ease of casting the Ni—Nb-based alloys of the invention into larger bulk objects or to increase the processability of the alloys. Additional alloying elements of potential interest are Fe, Co, Mn, and Cu, which can each be used as fractional replacements for Ni; Zr, Ti, Hf, V, Ta, Cr, Mo, W and Ta, which can be used as fractional replacements for Nb; and B, Al, Sb and Si, which can be used as fractional replacements for Nb.

It should be understood that the addition of the above mentioned additive alloying elements may have a varying degree of effectiveness for improving the processability of the Ni—Nb-base alloys in the spectrum of compositional ranges described above and below, and that this should not be taken as a limitation of the current invention.

Given the above discussion, in general, the Ni—Nb-base alloys of the current invention can be expressed by the following general formula (where a, b, c are in atomic percentages and x, y, z are in fractions of whole):

$$(Ni_{1-x}\ TM_x)_a((Nb,\ Ta)_{1-y}ETM_y)b\ (Sn_{1-z}AM_z)_c,$$

where a is in the range of from 50 to 65, b in the range of 30 to 45, c is in the range of 2 to 10 in atomic percentages; ETM is an early transition metal selected from the group of Ti, Zr, Hf, Cr, Mo, and W; TM is a transition metal selected from the group of Mn, Fe, Co, and Cu; and AM is an additive material selected from the group of B, Al, Si, and Sb. In such an embodiment the following constraints are given for the x, y and z fraction: x is less than 0.2, y is less than 0.3, z is less than 0.5, and the sum of x, y and z is less than about 0.5.

Preferably, the Ni—Nb-base alloys of the current invention are given by the formula:

$$(Ni_{1-x}\ TM_x)_a\ ((Nb,\ Ta)_{1-y}ETM_y)_b\ (Sn_{1-z}AM_z)_c,$$

where a is in the range of from 55 to 62, b in the range of 33 to 40, c is in the range of 2 to 8 in atomic percentages; ETM is an early transition metal selected from the group of Ti, Zr, Hf, Cr, Mo, and W; TM is a transition metal selected from the group of Mn, Fe, Co, and Cu; and AM is an additive material selected from the group of B, Al, Si, and Sb. In such an embodiment the following constraints are given for the x, y and z fraction: x is less than 0.1, y is less than 0.2, z is less than 0.3, and the sum of x, y and z is less than about 0.3.

Still more preferably, the Ni—Nb-base alloys of the current invention are given by the formula:

$$(Ni_{1-x}\ TM_x)_a\ (Nb_{1-y}\ ETM_y)_b\ (Sn_{1-z}AM_Z)_c,$$

where a is in the range of from 55 to 62, b in the range of 33 to 40, c is in the range of 2 to 8 in atomic percentages; ETM is an early transition metal selected from the group of Ti, Zr, and Ta; TM is a transition metal selected from the group of Fe, Co and Cu; and AM is an additive material selected from the group of B and Si. In such an embodiment, the following constraints are given for the x, y and z fraction: x is less than 0.1, y is less than 0.2, z is less than 0.3, and the sum of x, y and z is less than about 0.3.

For increased processability, the above mentioned alloys are preferably selected to have four or more elemental components. It should be understood that the addition of the above mentioned additive alloying elements may have a varying degree of effectiveness for improving the processability within the spectrum of the alloy compositional ranges described above and below, and that this should not be taken as a limitation of the current invention.

Other alloying elements can also be added, generally without any significant effect on processability when their total amount is limited to less than 2%. However, a higher amount of other elements can cause a degradation in the processability of the alloys, an particularly when compared to the processability of the exemplary alloy compositions described below. In limited and specific cases, the addition of other alloying elements may improve the processability of alloy compositions with marginal critical casting thicknesses of less than 1.0 mm. It should be understood that such alloy compositions are also included in the current invention.

Exemplary embodiments of the Ni—Nb-base alloys in accordance with the invention are described in the following:

In one exemplary embodiment of the invention the Ni—Nb-base alloys have the following general formula:

$$Ni_{100-a}Nb_bSn_c,$$

where 0.30<b<0.45, 0.02<c<0.10, and a is the sum of b and c.

In one preferred embodiment of the invention the Ni—Nb-base alloys have the following general formula:

$$Ni_{100-a}Nb_bSn_c$$

where 0.33<b<0.40, 0.02<c<0.10, and a is the sum of b and c.

In the most preferred embodiment of the invention the Ni—Nb-base alloys have the following general formula:

$$Ni_{100-a}Nb_bSn_c,$$

where 0.33<b<0.37, 0.02<c<0.05, and a is the sum of b and c.

Although in general, crystalline precipitates in bulk amorphous alloys are highly detrimental to their properties, especially to the toughness and strength, and as such generally preferred to a minimum volume fraction possible. However, there are cases in which, ductile crystalline phases precipitate in-situ during the processing of bulk amorphous alloys forming a mixture of amorphous and crystalline phases, which are indeed beneficial to the properties of bulk amorphous alloys especially to the toughness and ductility. These cases of mixed-phase alloys, where such beneficial precipitates co-exist with amorphous phase are also included in the current invention. In one preferred embodiment of the invention, the precipitating crystalline phases have body-centered cubic crystalline structure.

Alloys with this general formulation have been cast directly from the melt into copper molds to form fully amorphous strips or rods of thickness between 1 mm and 3 mm. Examples of these bulk metallic glass forming alloys are given in Table 1, below.

TABLE 1

New "Bulk" Refractory Alloy Glasses Based on Ni—Nb—Sn Ternary System.

| Alloy System | Critical Cast Thickness (mm) Plate | Rod | $T_g$ (K) | $T_x$ (K) | Vickers Hardness ($Kg/mm^2$) |
|---|---|---|---|---|---|
| $Ni_{60}Nb_{37}Sn_3$ | 1-1.5 | >1.5 | 895 | 937 | 1240 |
| $Ni_{60}Nb_{35}Sn_5$ | 1-1.5 | >1.5 | 885 | 943 | |
| $Ni_{59.4}Nb_{36.63}Sn_{2.97}$ | 2-3 | >3 | | | |
| $Ni_{59.35}Nb_{34.45}Sn_{6.2}$ | 2-3 | >3 | 882 | 930 | 1280 |
| $Ni_{59.5}Nb_{33.6}Sn_{6.9}$ | 2-3 | >3 | 881 | 931 | 1025 |
| $Ni_{57}Nb_{35}Fe_3Sn_5$ | 1-1.5 | >1.5 | 886 | 915 | 1013 |
| $Ni_{55}Nb_{37}Fe_3Sn_5$ | 0.5-1 | >1 | | | |
| $Ni_{57}Nb_{37}Fe_3Sn_3$ | 0.5-1 | >1 | | | 937 |
| $Ni_{55}Nb_{35}Fe_5Sn_5$ | 0.5-1 | >1 | | | 1169 |
| $Ni_{60}Nb_{35}Sn_3B_2$ | 0.5-1 | >1 | | | 1000 |
| $Ni_{60}Nb_{36}Sn_3B_1$ | 2-3 | >3 | | | 1095 |
| $Ni_{60}Nb_{36.5}Sn_3B_{0.5}$ | 0.5-1 | >1 | | | |
| $Ni_{60}Nb_{34}Sn_5B_1$ | 0.5-1 | >1 | | | |
| $Ni_{55}Nb_{31}Sn_9Cu_5$ | 0.5-1 | | | | |
| $Ni_{55}Nb_{31}Sn_6Zr_3Mn_5$ | 2 | | | | |
| $Ni_{55}Nb_{28}Sn_9Cu_5Zr_3$ | 0.5 | | | | |
| $Ni_{55}Nb_{28}Sn_6Zr_6Co_5$ | 2 | | | | |
| $Ni_{60}Nb_{23}Sn_6Zr_3Ti_8$ | 2 | | | | |
| $Ni_{55}Nb_{31}Sn_6Zr_3Co_5$ | 2 | | | | |
| $Ni_{55}Nb_{29}Sn_8Zr_3Co_5$ | 2 | | | | |
| $Ni_{55}Nb_{28}Sn_6Zr_3Co_5Ti_3$ | 2 | | | | |

The above table gives the maximum thickness for which fully amorphous strips are obtained by metal mold casting using this exemplary formulation. Evidence of the amorphous nature of the cast strips can be determined by x-ray diffraction spectra. Typical x-ray diffraction spectra for fully amorphous alloy strips is provided in FIG. 1*a*.

Another measurement of the processability of amorphous alloys can be described by defining a ΔTsc (super-cooled liquid region), which is a relative measure of the stability of the viscous liquid regime of the alloy above the glass transition. ΔTsc is defined as the difference between Tx, the onset temperature of crystallization, and Tsc, the onset temperature of the super-cooled liquid region. These values can be conveniently determined using standard calorimetric techniques such as DSC measurements at 20° C./min. For the purposes of this disclosure, Tg, Tsc and Tx are determined from standard DSC (Differential Scanning Calorimetry) scans at 20° C./min. Tg is defined as the onset temperature of glass transition, Tsc is defined as the onset temperature of super-cooled liquid region, and Tx is defined as the onset temperature of crystallization. Other heating rates such as 40° C./min, or 10° C./min can also be utilized while the basic physics of this technique are still valid. All the temperature units are in ° C. Generally, a larger ΔTsc is associated with a lower critical cooling rate, though a significant amount of scatter exists at ΔTsc values of more than 40° C. Bulk-solidifying amorphous alloys with a ΔTsc of more than 40° C., and preferably more than 60° C., and still more preferably a ΔTsc of 90° C. and more are very desirable because of the relative ease of fabrication.

Figure 1B:
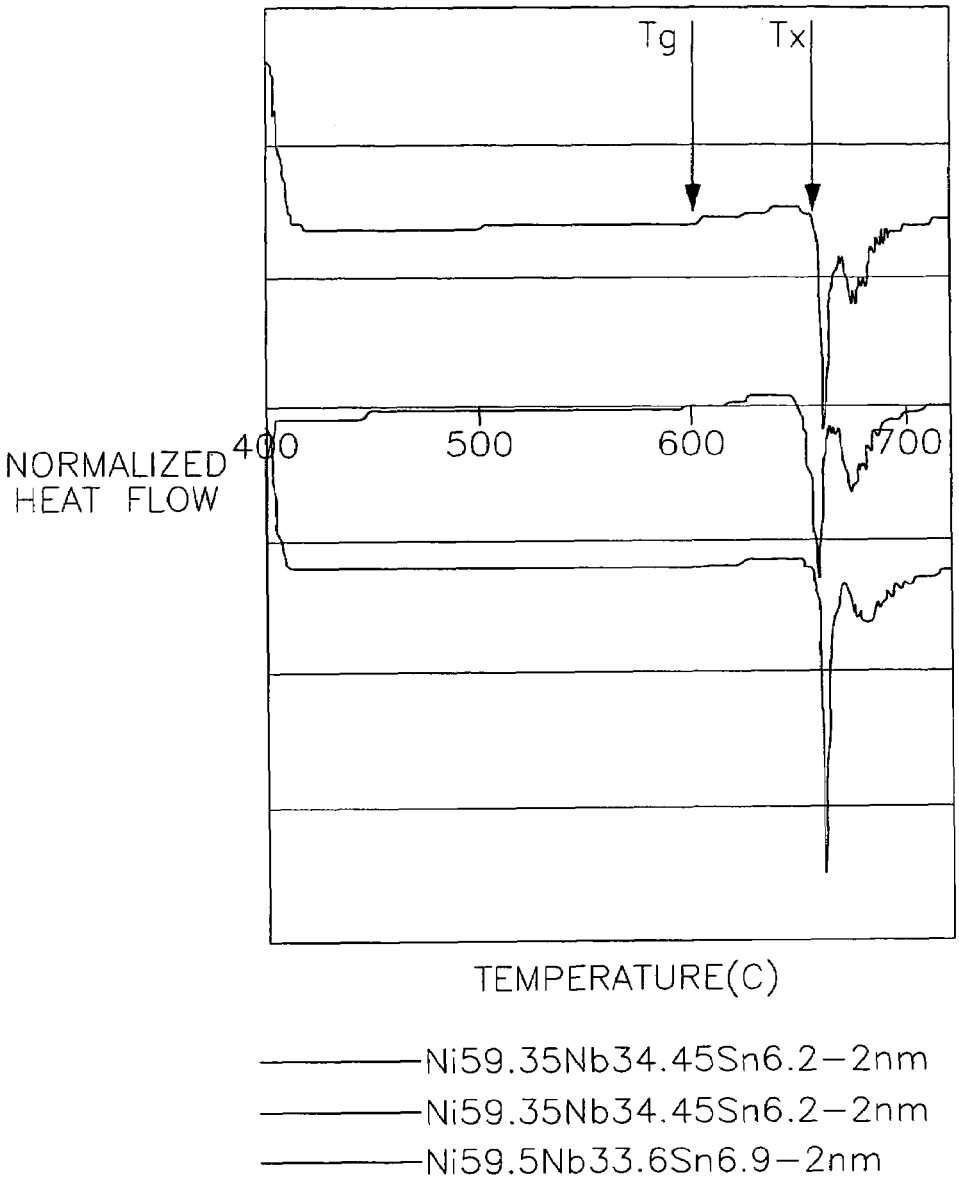
FIG. 1*b* is a graphical depiction of differential scanning calorimetry plots of an exemplary bulk amorphous alloy.

Typical examples of DSC scans for fully amorphous strips are also given in FIG. 1*b*. The vertical arrows in FIG. 1*b* indicate the location of the observed glass transition and the observed crystallization temperature of an exemplary alloy which was cast into 2 mm thick amorphous strips. Further, the table above gives the measured glass transition temperature and crystallization temperatures obtained for the alloys using Differential Scanning Calorimetry scans at heating rates of 10-20 K/s. The difference between Tg and Tx, ΔT=Tx−Tg, is measure of the temperature range over which the supercooled liquid is stable against crystallization when the glass is heated above Tg. The value of ΔT is a measure of the "processabilty" of the amorphous material upon subsequent heating. Values of this parameter are also given in Table 1, as reported values ranging up to ΔT~50 K are observed.

To assess the strength and elastic properties of these new metallic glasses, we have carried out measurements of the Vickers Hardness. Typical data are also shown in Table 1. Typical values range from V.H.=940 to 1280. Based on this data, and using empirical scaling rules, one can estimate the yield strength, Y.S. of these materials. Here we have used the approximate formula:

$$Y.S.=(V.H.)\times 3$$

where the approximate yield strength is given in MPa and the Vickers Hardness is given in $Kg/mm^2$. The yield strength values can be as high as 3 GPa and have the largest values of Y.S. of any bulk amorphous alloys reported to date. The elastic constants for several selected alloys were measured using ultrasonic methods. Table 2, below, gives values of the elastic shear modulus, G, Poisson's ratio, v, and Young's modulus, E. Young's modulus falls in the range of 160-250 GPa These values are among the highest obtained so far for any bulk amorphous metals.

TABLE 2

Elastic Constant/Properties for Ni—Nb—Sn based refractory bulk metallic glasses.

| Sample | Density (g/cc) | Poisson's ratio, Cryst | Poisson's Ratio, Amorphous | Cryst G (GPa) | Amorphous G (GPa) | Cryst E (GPa) | Amorphous E (GPa) |
|---|---|---|---|---|---|---|---|
| $Ni_{57}Fe_3Nb_{35}Sn_5$ | 8.67641 | 0.358 | 0.376 | 49.16564 | 60.51311 | 133.5097 | 166.496983 |
| $Ni_{55}Fe_5Nb_{35}Sn_5$ | 8.65565 | 0.317 | 0.364 | 63.34598 | 79.05788 | 166.8914 | 215.699586 |
| $Ni_{57}Fe_3Nb_{37}Sn_3$ | 8.70251 | 0.337 | 0.379 | 60.66459 | 61.77258 | 162.2551 | 170.320605 |
| $Ni_{55}Nb_{37}Fe_3Sn_5$ | 8.58381 | 0.323 | 0.344 | 64.73702 | 68.08545 | 171.2377 | 183.020901 |
| $Ni_{60}Nb_{35}Sn_3B_2$ | 8.60905 | 0.331 | — | 54.809 | — | 145.9102 | — |
| $Ni_{60}Nb_{35}Sn_5$ | 8.70755 | 0.368 | 0.385 | 51.73466 | 66.32919 | 141.5711 | 183.667094 |

As can be seen in the Table above, certain fractions of the Ni, Nb, and Sn can be successfully replaced by other elements and still yield glass formation in cast strips of 1 mm or more. For example, up to about 0.05 to 0.1 fractions of the Ni has been successfully replaced by Co, Cu or Fe. Small additions of B (~0.01-0.02) actually result in somewhat improved glass forming ability. From these studies it can be shown that some exemplary alloy compositions with yield strength exceeding 2,000 MPa are: $Ni_{60}$ $Nb_{36}Sn_3$ $B_1$; $Ni_{60}$ $Nb_{34}Sn_6$ $Zr_3$; $Ni_{60}$ $Nb_{35}Sn_5$; and $Ni_{60}Nb_{37}Sn_3$.

In another embodiment of the invention, the Nb content is partially or fully replaced by Ta.

The melting point of the initial crystalline alloy is also of interest in processing these materials. Differential Thermal Analysis (DTA) has been used to measure the temperatures where melting begins (on heating). This is called the solidus temperature, $T_S$. The highest temperature where melting is complete (on heating) is called the liquidus temperature of the alloy, $T_L$. Typical values of these temperatures for exemplary alloys are given in Table 3, below. The ratio, $Tg/T_L$, is often used as an indication of the glass forming ability of metallic alloys. For the present Ni—Nb—Sn type bulk amorphous alloys, this ratio is typically in the range of 0.6, characteristic of metallic alloys with good glass forming ability.

TABLE 3

DTA measurements Ni—Nb—Sn Alloys/Solidus and Liquidus Temperatures

| $T_m/T_l$ (° C.) | $Ni_{60}Nb_{35}Sn_5$ | $Ni_{60}Nb_{33}Sn_7$ | $Ni_{60}Nb_{31}Sn_9$ |
|---|---|---|---|
| $T_s$ | 1090 | 1090 | 1090 |
| $T_l$ | 1160 | 1134 | 1130 |

In sum, the inventors discovered a new family of bulk metallic glass forming alloys having exceedingly high values of hardness, elastic modulus (E), yield strength, and glass transition temperature, Tg. The values of these characteristic properties are among the highest reported for any known metallic alloys which form bulk metallic glass. Here, "bulk" is taken to mean that the alloys have a critical casting thickness of the order of 0.5 to 1.0 mm or more. The properties of these new alloys make them ideal candidates for many engineering applications.

The invention is also directed to methods of casting these alloys into three-dimensional bulk objects, while retaining a substantially amorphous atomic structure. In such an embodiment, the term three dimensional refers to an object having dimensions of least 0.5 mm in each dimension. The term "substantially" as used herein in reference to the amorphous alloy (or glassy alloy) means that the metal alloys are at least fifty percent amorphous by volume. Preferably the metal alloy is at least ninety-five percent amorphous and most preferably about one hundred percent amorphous by volume.

Although specific embodiments are disclosed herein, it is expected that persons skilled in the art can and will design alternative Ni—Nb-base alloys that are within the scope of the following claims either literally or under the Doctrine of Equivalents.

What is claimed is:

1. A glass forming alloy having a composition given by:

$$(Ni_{1-x}\ TM_x)_a\ ((Nb, Ta)_{1-y}ETM_y)_b(Sn_{1-z}AM_z)_c,$$

where ETM is an early transition metal selected from the group consisting of Ti, Zr, Hf, Cr, Mo, and W; TM is a transition metal selected from the group consisting of Mn, Fe, Co, and Cu; and AM is an additive material selected from the group consisting of B, Al, Si, and Sb;

where a is in the range of from 50 to 65, b in the range of 30 to 45, c is in the range of 2 to 10 in atomic percentages; and where x is less than 0.2, y is less than 0.3, z is less than 0.5, and the sum of x, y and z is less than about 0.5.

2. The glass forming alloy described in claim 1 wherein the alloy has a ΔTsc of more than 40° C.

3. The glass forming alloy described in claim 1 wherein the liquidus temperature of the alloy is 1160° C. or less.

4. The glass forming alloy described in claim 1 wherein the alloy has a Vickers hardness greater than 940 $Kg/mm^2$.

5. The glass forming alloy described in claim 1 wherein the alloy has a yield strength of greater than 2 GPa.

6. The glass forming alloy described in claim 1 wherein the alloy has a yield strength of about 3 GPa or more.

7. The glass forming alloy described in claim 1 wherein the alloy has a Young's modulus of greater than 160 GPa.

8. The glass forming alloy described in claim 1 wherein the alloy has a ratio of glass transition temperature to liquidus temperature of around 0.6 or more.

9. The glass forming alloy described in claim 1 wherein the alloy is substantially amorphous.

10. The glass forming alloy described in claim 1 wherein the alloy contains a ductile crystalline phase precipitate.

11. The glass forming alloy described in claim 1 wherein the alloy is $Ni_{60}Nb_{37}Sn_3$.

12. The glass forming alloy described in claim 1 wherein the alloy is $Ni_{55}Fe_5Nb_{35}Sn_5$.

13. The glass forming alloy described in claim 1 wherein the alloy is $Ni_{60}Nb_{35}Sn_3B_2$.

14. The glass forming alloy described in claim 1 wherein the alloy is $Ni_{55}Nb_{31}Sn_9Cu_5$.

15. The glass forming alloy described in claim 1 wherein the alloy is $Ni_{55}Nb_{28}Sn_6Zr_3Co_5Ti_3$_1 .

16. A glass forming alloy having a composition given by:

(Ni1-xTMx)a(Nb1-yETMy)b(Sn1-zAMz)c wherein ETM is an early transition metal selected from the group consisting of Ti, Zr, and Ta; TM is a transition metal selected from the group consisting of Fe, Co, and Cu; and AM is an additive material selected from the group consisting of B, and Si;

wherein a is in the range of from 55 to 62b is in the range of from 33 to 40, and c is in the range of from 2 to 8 in atomic percentages; and where x is less than 0.1, y is less than 0.2, z is less than 0.3, and the sum of x, y and z is less than about 0.3.

17. An article made of an amorphous alloy of basic composition given by:

$$(Ni_{1-x}\ TM_x)_a\ ((Nb, Ta)_{1-y}ETM_y)_b\ (Sn_{1-z}AM_z)_c,$$

where ETM is an early transition metal selected from the group consisting of Ti, Zr, Hf, Cr, Mo, and W; TM is a transition metal selected from the group consisting of Mn, Fe, Co, and Cu; and AM is an additive material selected from the group consisting of B, Al, Si, and Sb;

where a is in the range of from 50 to 65, b in the range of 30 to 45, c is in the range of 2 to 10 in atomic percentages;

where x is less than 0.2, y is less than 0.3, z is less than 0.5, and the sum of x, y and z is less than about 0.5.

18. The article described in claim 17 wherein the amorphous alloy has a ΔTsc of more than 40° C.

19. The article described in claim 17 wherein the liquidus temperature of the amorphous alloy is 1160° C. or less.

20. The article described in claim 17 wherein the amorphous alloy has a Vickers hardness greater than 940 $Kg/mm^2$.

21. The article described in claim 17 wherein the amorphous alloy has a yield strength of greater than 2 GPa.

22. The article described in claim 17 wherein the amorphous alloy has a yield strength of about 3 GPa or more.

23. The article described in claim 17 wherein the amorphous alloy has a Young's modulus greater than 160 GPa.

24. The article described in claim 17 wherein the amorphous alloy has a ratio of glass transition temperature to liquidus temperature of around 0.6 or more.

25. The article described in claim 17 wherein the alloy contains a ductile crystalline phase precipitate.

26. The article described in claim 17 wherein the article is three dimensional having a size of least 0.5 mm in each dimension.

27. The article described in claim 17 wherein the article is three dimensional having a size of least 1.0 mm in each dimension.

28. An article made of an amorphous alloy of basic composition given by:

$$(Ni_{1-x}TM_x)_a(Nb_{1-y}ETM_y)_b(Sn_{1-z}AM_z)_c$$

wherein ETM is an early transition metal selected from the group consisting of Ti, Zr, and Ta; TM is a transition metal selected from the group consisting of Fe, Co, and Cu; and AM is an additive material selected from the group consisting of B, and Si;

wherein a is in the range of from 55 to 62, b is in the range of from 33 to 40, and c is in the range of from 2 to 8 in atomic percentages; and where x is less than 0.1, y is less than 0.2, z is less than 0.3, and the sum of x, y and z is less than about 0.3.

* * * * *